US006514028B2

(12) United States Patent
Yeoman

(10) Patent No.: US 6,514,028 B2
(45) Date of Patent: Feb. 4, 2003

(54) DEVICE AND METHOD FOR SIDE WIRE BINDING

(75) Inventor: Edwin H. Yeoman, Tipp City, OH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/572,360

(22) Filed: May 17, 2000

(65) Prior Publication Data

US 2003/0002954 A1 Jan. 2, 2003

(51) Int. Cl.[7] ..... B42B 2/00

(52) U.S. Cl. ..... 412/35; 412/1; 412/14; 412/25; 412/39

(58) Field of Search ..... 412/35, 1, 16, 412/39, 2, 4, 6, 8, 9, 14, 25, 36; 281/21.1; 270/32, 37

(56) References Cited

U.S. PATENT DOCUMENTS

| | | | | | |
|---|---|---|---|---|---|
| 2,024,959 A | * | 12/1935 | Alger | ..... | 412/35 |
| 3,317,026 A | | 5/1967 | Zugel et al. | ..... | 198/133 |
| 4,032,131 A | * | 6/1977 | Davis | ..... | 270/37 |
| 4,184,218 A | * | 1/1980 | Hawkes | ..... | 281/21.1 |
| 4,436,469 A | * | 3/1984 | Kelly | ..... | 412/16 |
| 4,653,972 A | * | 3/1987 | Lewis | ..... | 412/37 X |
| 4,697,971 A | | 10/1987 | Muller | ..... | 412/33 |
| 4,925,354 A | * | 5/1990 | Cote | ..... | 412/37 X |
| 5,788,446 A | | 8/1998 | Stolz | ..... | 412/9 |

* cited by examiner

*Primary Examiner*—Willmon Fridie, Jr.
(74) *Attorney, Agent, or Firm*—Davidson, Davidson & Kappel, LLC

(57) ABSTRACT

A side wire stitching binder includes at least one side wire stitcher for stitching a book through a side of the book, a cover station for applying a cover over a spine of the book, and a clamping device including a clamp for transferring the book from the at least one side wire stitcher to the cover station. Also disclosed is a method for binding a book comprising the steps of clamping an unstitched book with a first clamp, side stitching the book while clamped in the first clamp, and transporting the book to a cover station using the first clamp.

12 Claims, 2 Drawing Sheets

DEVICE AND METHOD FOR SIDE WIRE BINDING

BACKGROUND OF THE INVENTION

1. Field of the Invention

The present invention relates generally to binding and more particularly to a device and method for binding a collated product using a side wire stitcher.

2. Background Information

To form books (defined herein to include all sheet and signature assemblages), sheets or signatures typically are collated or assembled so that the sheets of the book are arranged in the desired order. The books are then bound.

Traditional binding methods include saddleback stitching and perfect binding. With saddleback stitching, the sheets of the book typically are conveyed so that a fold in the sheets is presented to a stitching device, with the sheets hanging downward in a saddle-like fashion. U.S. Pat. No. 3,317,026 to Zugel et al., for example, discloses a saddleback stitching device with two saddle stitchers.

Saddleback stitching devices have the disadvantage that the spine of the book is not flat. For high-quality binding or larger books, this type of binding can be undesirable.

Perfect binders prepare a book for gluing or adhesion by registering the sheets or signatures of the book so that the sheets or signatures of the book present themselves along a spine of the book. U.S. Pat. Nos. 4,697,971 and 5,788,446 for example purport to disclose perfect binders. A book cover typically will be bound with glue at a separate cover station.

Perfect binders have the disadvantage that the glued spine can degrade after repeated use.

To improve on perfect binders and to provide for longer lasting binding in addition to the other advantages of perfect binding, it has been known to side wire stitch the signatures or sheets using stand alone stitching machines. National Geographic magazine, for example, traditionally has been side wire stitched. With side wire stitching, books typically are registered and clamped as with perfect binders, and then stitched from the side. These stitching units however require a special connection area prior to a covering machine, and the books thus must be transferred from the stitching machines to a separate cover machine, which can lead to malfunctions. The stitching machines also take up significant floor space, and are slow in operation. As a result, the books are often split into two streams, adding to the space requirements.

Moreover, the side wire stitching typically was performed in a collator raceway, with a loose collated book placed in a clamp to hold the set together for stitch application and then fully released by the clamp.

BRIEF SUMMARY OF THE INVENTION

An object of the present invention is to provide a method and device for improved side wire stitching.

The present invention provides a side wire stitching binder comprising at least one side wire stitcher for stitching a book through a side of the book, a cover station for applying a cover over a spine of the book, and a clamping device including a clamp for clamping the book in the at least one side wire stitcher and for transferring the book from the at least one side wire stitcher to the cover station.

By connecting the side wire stitcher and the cover station directly with a single clamp, the book may be tightly held in the clamp with higher clamp pressures and better registration. In addition, a transfer of the book between the side wire stitcher and the cover station can be avoided.

The binder may further include a first level shelf along which the spine may be registered and then firmly gripped by the clamp. A section of the book remains exposed below the clamp, so that side stitches may be applied to the exposed section.

The at least one side wire stitcher preferably includes two stitchers, so that every other book can be stitched by one of the stitchers, thus improving throughput of the binder.

The binder may also further include a backbone preparation device after the stitching devices for roughening the spine to improve cover application.

The cover station preferably includes a cover feeder, an applier drum and a cover breaker.

The binder also may include a second level shelf after the stitchers so as to reduce the amount of exposure of the books in the clamps. For example, the first level shelf may be placed with respect to the clamps such that ½ to one inch of the books is exposed below the clamping surface. After stitching, the second level shelf may be placed with respect to the clamps such that one quarter to ½ of one inch of the book remains exposed. This lesser exposure can aid in backbone preparation and cover application by providing a firmer grip closer to the spine.

The present invention also provides a method for binding a book comprising the steps of:

clamping the book with a first clamp;

side stitching the book while clamped in the first clamp; and transporting the book to a cover station using the first clamp.

By having the clamp perform both the side stitching support function and the transport to the cover station function, the quality of the binding can be improved.

BRIEF DESCRIPTION OF THE DRAWINGS

A preferred embodiment of the present invention is described below by reference to the following drawings, in which.

DETAILED DESCRIPTION

Figure 1:
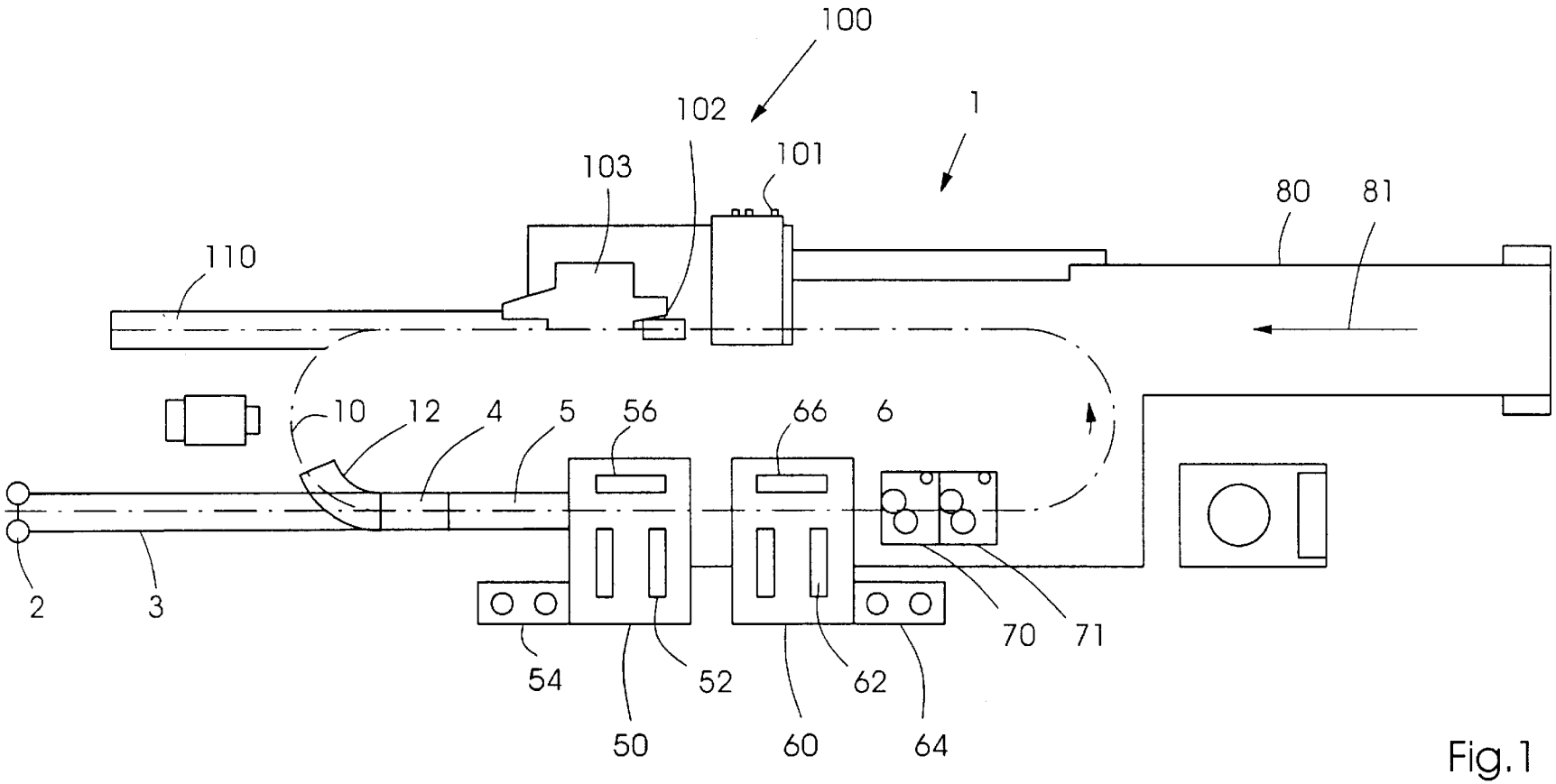
FIG. 1 shows a schematized top view of the binder according to the present invention.
Figure 2:
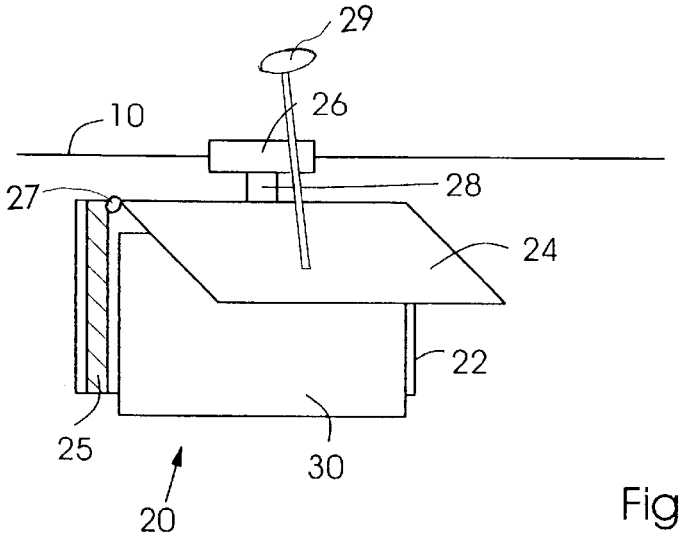
FIG. 2 shows a top view of a clamp of FIG. 1, with a product to be stitched entering a clamp at an infeed area.

FIG. 1 shows a schematized top view of a binder 1. An infeed 2 can feed incoming collated books in a spine down position onto a conveyor 3. A plurality of clamps travel in an endless loop 10. At a section 12 of loop 10, the clamps are in an open position, with one side of the clamp being in a vertical position, and the other side being raised. In a transfer area 4, books 30 are transferred from conveyor 3 against a first side 22 of clamp 20 in front of a stop 25, as shown in FIG. 2. Stop 25 is shown as a vertical bar, but may also be a register pin with a flat side, so that the pin is shaped like a backwards D letter. First side 22 remains in a vertical position and is generally fixed with respect to a carriage 26 and a support 28 traveling on loop or track 10. Alternately, a track directly at the back of first side 22 could be provided. Second side 24 is pivotable about a pivot 27 with respect to first side 22, and may be spring loaded to close against first side 22. A cam 29 attached to second side 24 can follow a cam follower to force the second side to open, as shown in FIG. 2.

Once book 30 contacts first side 22, the cam 29 can release from a cam follow so that side 24 is forced into closed position by spring-action (and which may be maintained by the spring action). Book 30 thus is in a vertical position, and may enter a first level shelf station 5, as shown in FIG. 1. Preferably, side 24 can lock over center so that both the open and closed positions can be maintained without cam contact, but a cam can move the side 24 between the two positions.

Figure 3:
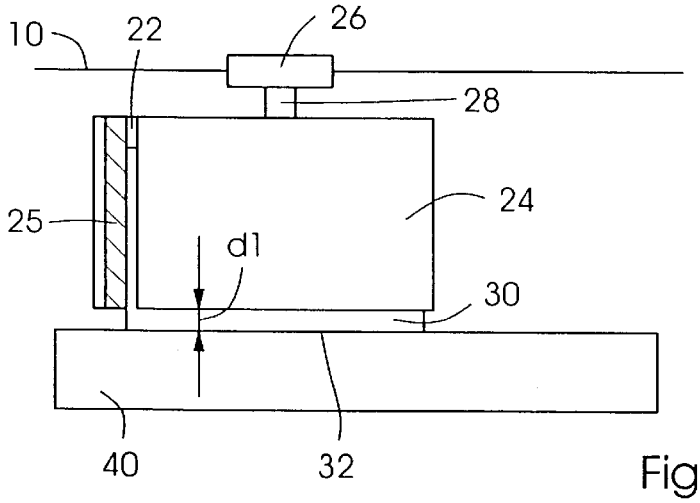
FIG. 3 shows a side view of a product to be stitched in a clamp on a level shelf.

As shown in FIG. 3 (which for clarity purposes does not show cam 29), in level shelf section 5, a spine 32 on book 30 runs along a level shelf 40. Second side 24 may be slightly released from first side 22, for example by virtue of cam action, so that book 30 registers against the level shelf 40 and rear stop 25, which is thicker than the thickness of book 30. Proper register of book 30 may thus be created, and a distance d1 can result between the edge of clamp sides 22 and 24 and the level shelf 40. This distance d1 preferably is between ½ and one inch.

Book 30 clamped in clamp 20 then enters a first side stitcher 50 with a pair of stitching heads 52 and a wire feed 54. First side stitcher 50 can place two wire stitches through the side of book 30. A clincher 56 can be placed opposite the stitching heads 52 to support the back side of the book 30 or clamp 20. An optional second side stitcher 60 can have stitching heads 62, wire feed 64 and clincher 66, and can be used so that each stitcher 50, 60 stitches every other book in alternating fashion, thereby increasing throughput.

Figure 4:
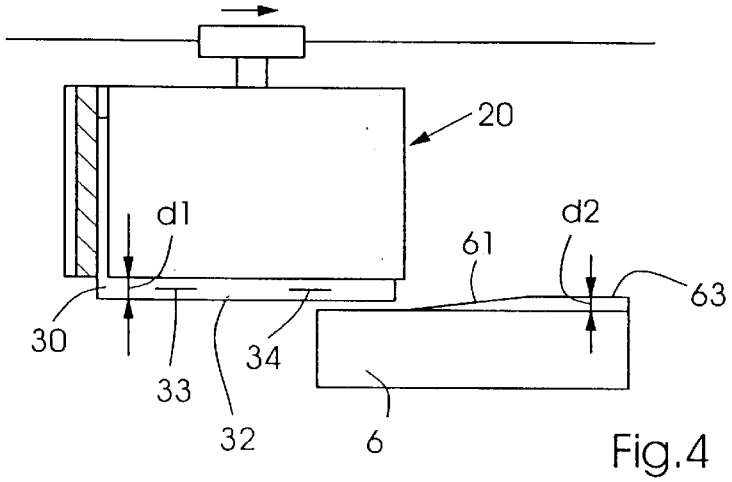
FIG. 4 shows a side view of a stitched product at a second level shelf.

As shown in FIG. 4, book 30 after exiting stitcher 50 is bound by side stitches 33, 34. Spine 32 of the book can then be prepared by a backbone preparation station 70 (FIG. 1), which can for example saw or roughen the spine to improve the spine surface for application of glue for the cover. An optional second backbone preparation station 71 can aid in increasing throughput of the binder.

It may be desirable to have clamp 20 hold the book closer to the spine during backbone preparation. An optional second level shelf 6 can be provided after the stitchers 50, 60 to reduce the distance d1. Clamp 20 can be slightly released so that book 30 slides up along a slope 61 while clamp 20 remains in a constant vertical position. Slope 61 rises a distance d2 at a flat section 63. Distance d2 is less than d1, so that the book spine 32 still protrudes a distance d1 subtracted by d2 beyond the bottom of clamp 20. Clamp 20 then can again grip book 30 firmly through backbone preparation station 70. The distance d1–d2 preferably is between one quarter and ½ of an inch. Alternately, the second level shelf 6 may be flat and the vertical position of clamp 20 may decrease by distance d2.

As clamps 20 exit backbone preparation station 70, clamps 20 move around loop 10 toward a cover station 100. Covers move from a cover feeder 80 in direction 81 and arrive underneath the clamps 20 on a conveyor belt. A cover adhesive can be delivered to the cover by an adhesive station 101, and an applier drum 102 can smooth the adhesive. At a cover breaker 103, the cover is forced against the spine 32, and the book 30 is released from clamp 20. If desired, the sides of the cover may be pressed partly against the cover as well.

The bound and covered books 30 then exit along a conveyor belt 110, while clamps 20 return along loop 10 to section 12, where clamps 20 are rotated about carriage 26 so that side 22 is again ready to receive a new book 30.

The present device provides for improved side stitching and for transfer of a book between the stitchers and the cover station using a single clamp, which can improve stitch placement and cover placement. In place of cams, it is conceivable that the movement of the clamp 20 and sides 22 and 24 could be motor-actuated. Loop 10 may include for example a motor-driven chain for driving carriages 26 at a constant velocity.

"Book" as defined herein includes all sheet material assemblages. "Clamp" as defined herein can include any device holding a book.

What is claimed is:

1. A side wire stitching binder comprising:

at least one side wire stitcher for stitching a book through a first side of the book, the book also having a second side opposing the first side;

a cover station for applying a cover over a spine of the book;

a clamping device including a clamp having a first clamp side and a second clamp side for clamping the book in the at least one side wire stitcher, the clamping device transferring the book from the at least one side wire stitcher to the cover station, the first clamp side contacting the first side of the book and the second clamp side contacting the second side of the book, both the first clamp side and the second clamp side moving with the book as the clamping device transfers the book from the at least one side wire stitcher to the cover station; and a level shelf contacting a spine of the book, the level shelf for leveling the spine of the book with respect to the clamp before the at least one side wire stitcher.

2. The side wire stitching binder as recited in claim 1 wherein the clamping device includes an endless loop, the clamp running on the endless loop between the at least one stitcher and the clamping device.

3. The side wire stitching binder as recited in claim 1 wherein at least one side wire stitcher includes two stitchers.

4. The side wire stitching binder as recited in claim 1 further comprising a backbone preparation device after the at least one side wire stitcher.

5. The side wire stitching binder as recited in claim 1 wherein the cover station includes a cover feeder, an applier drum and a cover breaker.

6. The side wire stitching device as recited in claim 1 further comprising a second level shelf contacting the spine of the book after the at least one side wire stitcher.

7. A method for binding a book comprising the steps of:

clamping an unstitched book in a vertical position with a first clamp having a first clamp side and a second clamp side, the first clamp side contacting a first side of the book and a second clamp side clamping an opposing second side of the book;

side stitching the book while clamped in the vertical position in the first clamp;

transporting the first clamp side and the second clamp side with the book to a cover station; and leveling a spine of the book on a level shelf.

8. The method as recited in claim 7 further including using a cam to actuate the first clamp.

9. The method as recited in claim 7 further including passing the spine of the book through a backbone preparation station using the first clamp.

10. The method as recited in claim 7 further comprising clamping a second book with a second clamp.

11. The method as recited in claim 7 further including returning the first clamp along a loop to clamp a second book.

12. A side wire stitching binder for books, each book having a first side and a second side, the binder comprising:

at least one side wire stitcher for stitching a book through the first side and second side of the book;

a cover station for applying a cover over a spine of the book; and a clamping device including a plurality of clamps, each clamp having a first clamp side and a second clamp side, each clamp with the first clamp side and second clamp side traveling in an endless loop, a first clamp of the plurality of clamps clamping both the first side and the second side of the book and transferring the book while clamped from the at least one side wire stitcher to the cover station; and a level shelf contacting a spine of the book, the level shelf for leveling the spine of the book with respect to the clamp before the at least one side wire stitcher.

* * * * *